US005853277A

United States Patent [19]

Everhart

[11] Patent Number: 5,853,277

[45] Date of Patent: Dec. 29, 1998

[54] GARBAGE CAN DUMP MECHANISM

[76] Inventor: Jeffrey M. Everhart, 2074 Welcome-Bethesda Rd., Welcome, N.C. 27374

[21] Appl. No.: 804,567

[22] Filed: Feb. 24, 1997

[51] Int. Cl.[6] ..... B66F 3/02

[52] U.S. Cl. ..... 414/408; 414/421

[58] Field of Search ..... 414/406, 408, 414/421, 555, 740

[56] References Cited

U.S. PATENT DOCUMENTS

| | | | |
|---|---|---|---|
| 3,747,785 | 7/1973 | Dahlin | 414/406 X |
| 4,365,922 | 12/1982 | Borders | 414/421 X |
| 4,422,814 | 12/1983 | Borders | 414/421 X |
| 4,479,751 | 10/1984 | Wyman et al. | 414/421 X |
| 4,580,940 | 4/1986 | Sheaves | 414/421 X |
| 4,613,271 | 9/1986 | Naab | 414/421 X |
| 5,024,573 | 6/1991 | Redding et al. | 414/408 |
| 5,026,241 | 6/1991 | Wyman | 414/421 X |
| 5,466,110 | 11/1995 | Redding | 414/408 X |
| 5,513,937 | 5/1996 | Huntoon et al. | 414/408 |

FOREIGN PATENT DOCUMENTS

| | | | |
|---|---|---|---|
| 512469 | 11/1992 | European Pat. Off. | 414/408 |
| 3500691 | 7/1986 | Germany | 414/408 |
| 2188302 | 9/1987 | United Kingdom | 414/408 |

*Primary Examiner*—James W. Keenan

[57] ABSTRACT

A garbage can dump mechanism is provided for attachment to the rear of a conventional garbage truck. The dump mechanism hydraulically lifts the garbage can from the ground through an arc to an inverted position to allow the garbage to flow by gravity from the can into the truck hopper. The garbage can is fitted with a pair of parallel rails for gripping by the dump mechanism. The dump mechanism has a fixed catch and a movable catch. After dumping, the dump mechanism rotates in a reverse direction, placing the emptied can on the ground so the cycle can begin anew.

2 Claims, 6 Drawing Sheets

GARBAGE CAN DUMP MECHANISM

BACKGROUND OF THE INVENTION

1. Field of the Invention

The invention herein pertains to dump mechanism and particularly to hydraulic dumping mechanisms as are affixed to garbage trucks for lifting and dumping garbage cans containing solid waste.

2. Description of the Prior Art and Objectives of the Invention

Solid waste collection and disposal for households has been simplified and made more efficient through the use of garbage trucks having hydraulic or other mechanisms which lift the can upwardly and dump it into the garbage truck. These devices eliminate much of the manual labor previously required. Special garbage cans adapted for mechanical lifting are usually supplied by the garbage collection service and are uniform in size and structure. Such garbage cans usually have wheels for easy movement by the homeowners and may have rings or rails to allow the dump mechanisms to grip them in a secure manner as they are hoisted for dumping.

One of the more popular dump mechanisms is affixed to the rear of garbage trucks and is hydraulically operated. Such dump mechanisms, include a planar can support having a fixed catch and a movable catch positioned within an aperture of the can support. One of the can rails is first manually manipulated within the fixed catch by the operator. Next, the hydraulic assembly is controlled, usually by a lever so the can support lifts and rotates the garbage can. During lifting the movable catch engages the second garbage can rail to secure the garbage can in its inverted position during dumping. As the can is lowered after dumping, by control of the hydraulic assembly, the movable catch releases the rail. Once the garbage can is returned to the pavement, it is manually removed from the fixed catch and another can is positioned against the can support and in engagement with the fixed catch whereby the dumping cycle repeated. Such conventional dump mechanisms usually have scissor arms or assemblies which constantly wear with use and can quickly develop uneven movements. Such uneven movements place additional stress on the joints and bearing surfaces of the dump mechanism, causing greater friction increases and more wear, ultimately resulting in failure. It is not unusual for such conventional dump mechanisms to fail in about one year of service.

With the disadvantages and problems associated with prior art garbage can dump mechanisms, the present invention was conceived and one of its objectives is to provide an improved hydraulic garbage can dump mechanism which can be retrofitted to standard garbage trucks.

It is another objective of the present invention to provide a garbage can dump mechanism which will smoothly and evenly lift and rotate a garbage can during dumping without excess wear on the mechanism parts.

It is still another objective of the present invention to provide a garbage can dump mechanism which includes a trio of parallel rollers which are rigidly affixed relative to one another.

It is yet another objective of the present invention to provide an L-shaped bracket positioned at each end of the trio of parallel rollers to maintain their spatial alignment and to prevent undue wear during operation.

It is yet another objective of the present invention to provide a dump mechanism which can be built at a relatively low cost and which will remain trouble-free for a number of years under adverse use conditions.

Various other objectives and advantages of the present invention will become apparent to those skilled in the art as a more detailed description is set forth below.

SUMMARY OF THE INVENTION

The aforesaid and other objectives are realized by providing a hydraulically operated dump mechanism on the rear of a conventional solid waste garbage truck. The dump mechanism includes a planar can support having both a fixed and a biased movable catch for engaging conventional rails of a garbage can. With the garbage can manually positioned on the fixed catch, the hydraulic assembly is manually operated causing the can support to pivot in an arcuate manner to dump the solid waste into the truck hopper. After dumping, by again manually operating the hydraulic assembly, the can support is pivoted in a reverse direction to lower the emptied garbage can to the pavement below where the empty can is removed. During the lifting motion the pivotable catch is urged by coil spring members into engagement with a second rail on the garbage can and as the can is lowered, the movable catch is likewise withdrawn from the second rail to allow the can to be quickly and easily removed from the can support. The can support is attached to a trio of spatially fixed parallel rollers which are maintained in position by a pair of L-shaped brackets at opposite ends thereof. By fixing the rollers relative one to another, the stress on the dump mechanism is lessened, allowing the device to have a longer life and to operate more smoothly than conventional mechanisms.

DETAILED DESCRIPTION OF THE PREFERRED EMBODIMENT AND OPERATION OF THE INVENTION

Figure 1:
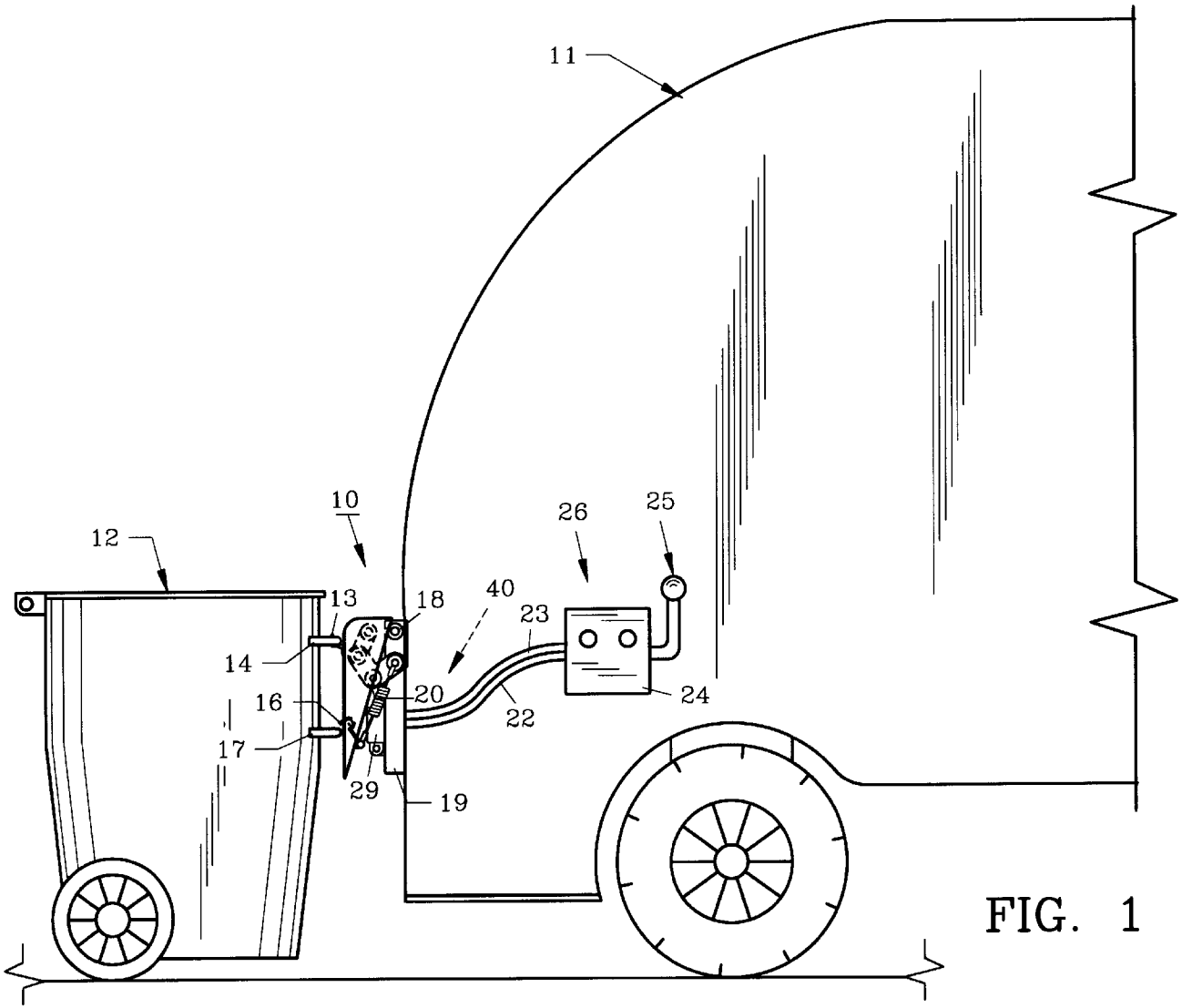
FIG. 1 illustrates the preferred form of the dump mechanism attached to the rear of a garbage truck with the fixed catch engaging the top rail of the garbage can.

For a better understanding of the invention and its use, turning now to the drawings, the preferred form of garbage can dump mechanism 10 is shown in FIGS. 1–5. In FIG. 1, a conventional garbage truck 11 for receiving the contents of garbage can 12 is pictured with fixed catch 13 positioned on garbage can rail 14 (seen enlarged in FIG. 3). Fixed catch 13 is rigidly mounted such as by welding to garbage can support 15 which is pivotally attached to roller 18 to planar mounting member 19. Mounting member 19 is attached to truck 11 such as by welding.

Figure 2:
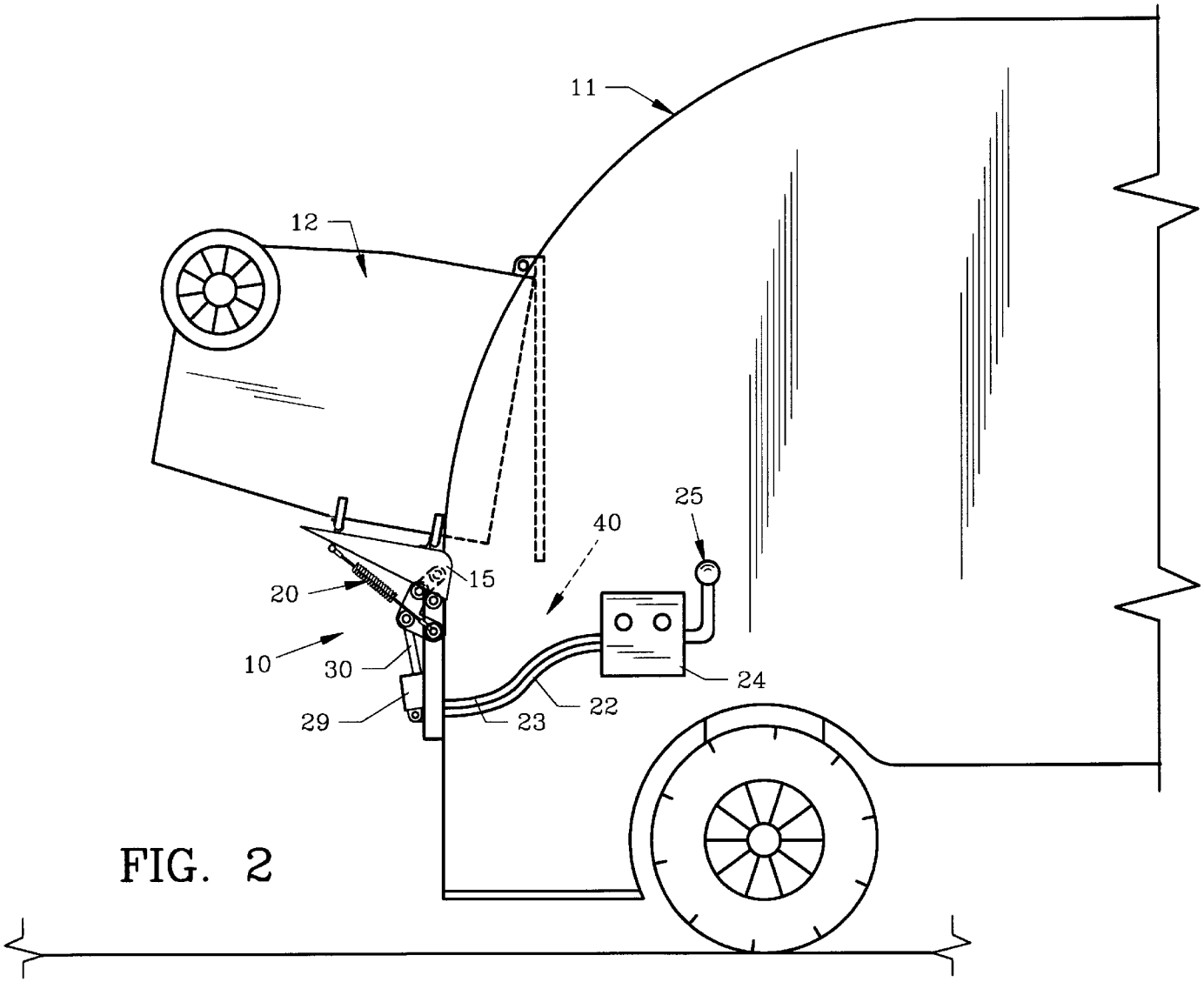
FIG. 2 demonstrates the dump mechanism of FIG. 1 but pivoted approximately 100° to begin the dumping action.
Figure 3:
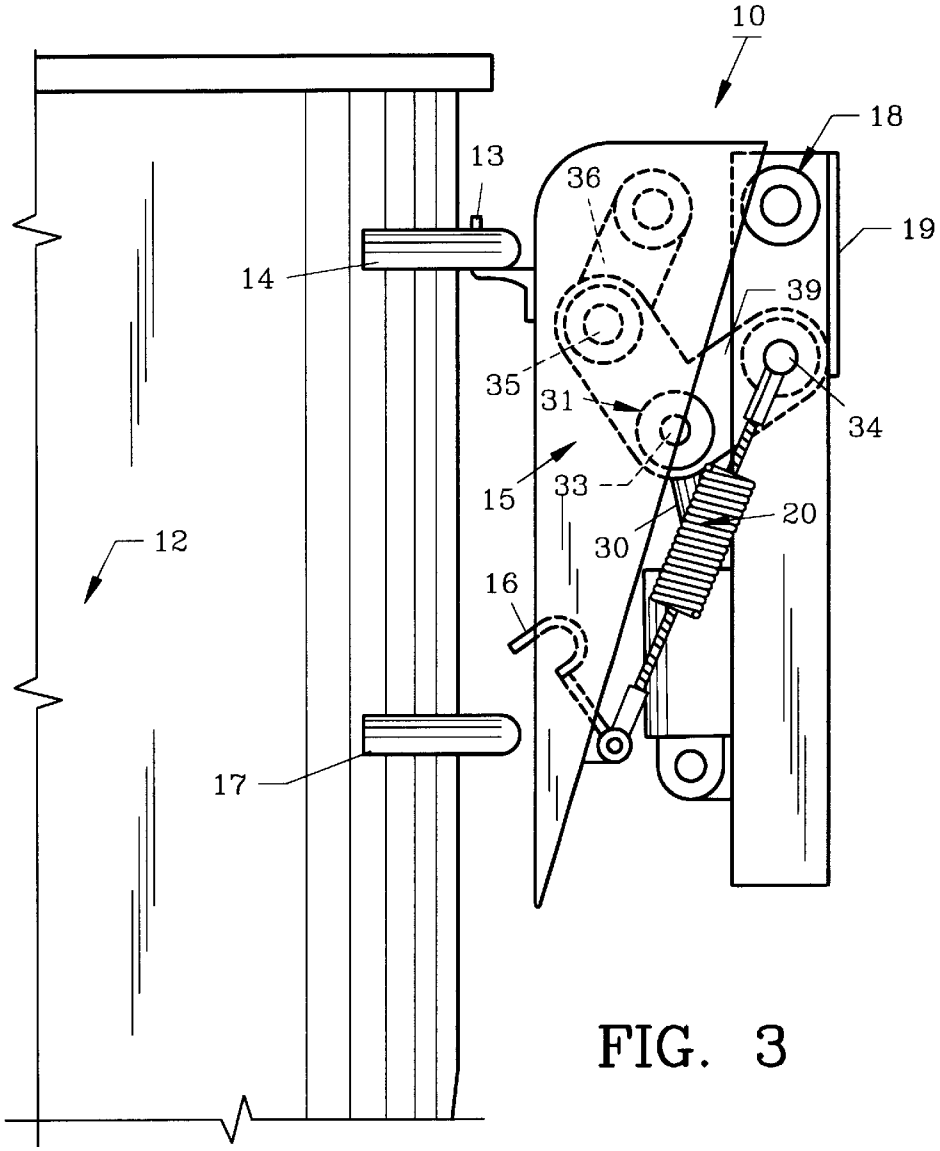
FIG. 3 illustrates an enlarged view of the dump mechanism as seen in FIG. 1, but removed from the garbage truck.

With garbage can 12 so positioned as shown in FIGS. 1 and 3, handle 25 of hydraulic assembly 26 is activated causing hydraulic cylinder 29 to extend rod 30 upwardly. As shown, piston rod 30 is connected to roller sleeve 31 (FIGS. 3 and 4) which contains roller 33. Thus, as piston rod 30 extends, roller 33 is forced upwardly to thereby raise can support 15 causing it to pivot in an arcuate clockwise direction towards garbage truck 11 as shown in FIG. 2. Hydraulic assembly 26 includes control valve 24 connected to hydraulic lines 22 and 23 which are also connected to hydraulic cylinder 29.

Figure 4:
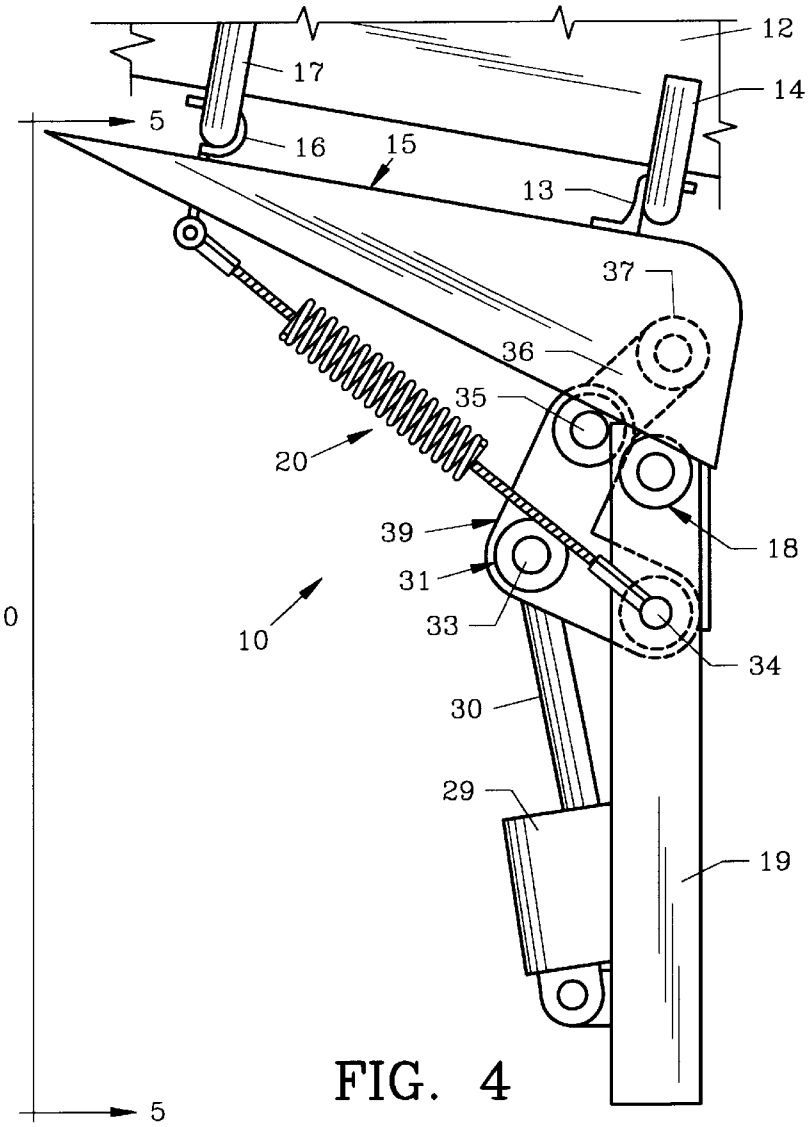
FIG. 4 pictures the dump mechanism enlarged as shown in FIG. 3 but pivoted approximately 100° as in FIG. 2.
Figure 5:
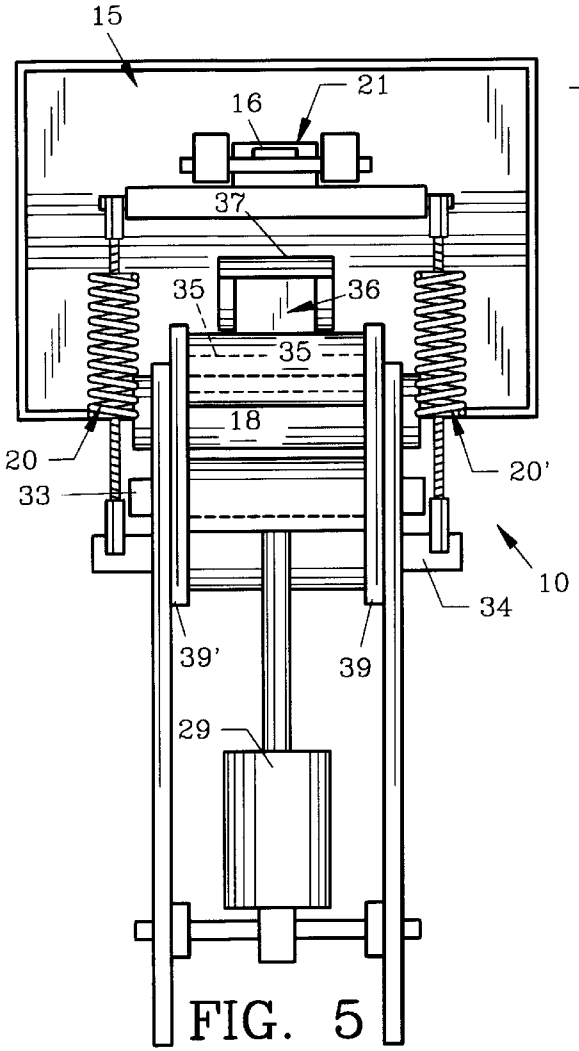
FIG. 5 features the dump mechanism of FIG. 4 along lines 5—5.

In FIG. 2, garbage can 12 has been lifted and pivoted in a clockwise direction for dumping the contents into garbage truck hopper 40 therebelow as conventional. As garbage can support 15 moves in a clockwise arc, movable catch 16 is urged in a counter-clockwise direction from its rest position as shown in FIG. 3, into engagement with garbage can rail 17 as shown in FIG. 4. Thus, garbage can 12 is securely held during horizontal and inverted positions while being dumped. Movable catch 16 is biased by springs 20, 20' as seen in FIG. 5 within catch aperture 21 of can support 15. As shown in FIG. 1, movable catch 16 is substantially concealed within can support 15 when resilient coil springs 20, 20' are at rest. However, as dump mechanism 10 begins its arcuate dumping path, by operation of hydraulic assembly 26, coil springs 20, 20' become biased, causing movable catch 16 to tightly engage rail 17. Spring members 20, 20' are joined at the opposite ends of roller 34, as seen in FIGS. 4 and 5. Garbage can support 15 is joined to roller 35 and linkage 36 as seen in FIG. 4. Roller 37 is rigidly affixed as by welding to can support 15.

As further shown in FIGS. 1–5, the parallel trio of rollers 33, 34 and 35 are spatially fixed relative to each other by opposing L-shaped brackets 39, 39' as clearly shown in FIG. 5. First roller 33, second roller 34 and third roller 35 are contained within sleeves for protection and durability. L-shaped brackets 39, 39' prevent excess roller wear by tandem roller movement as can support 15 is repeatedly pivoted upwardly and downwardly during dumping operations.

Figure 6:
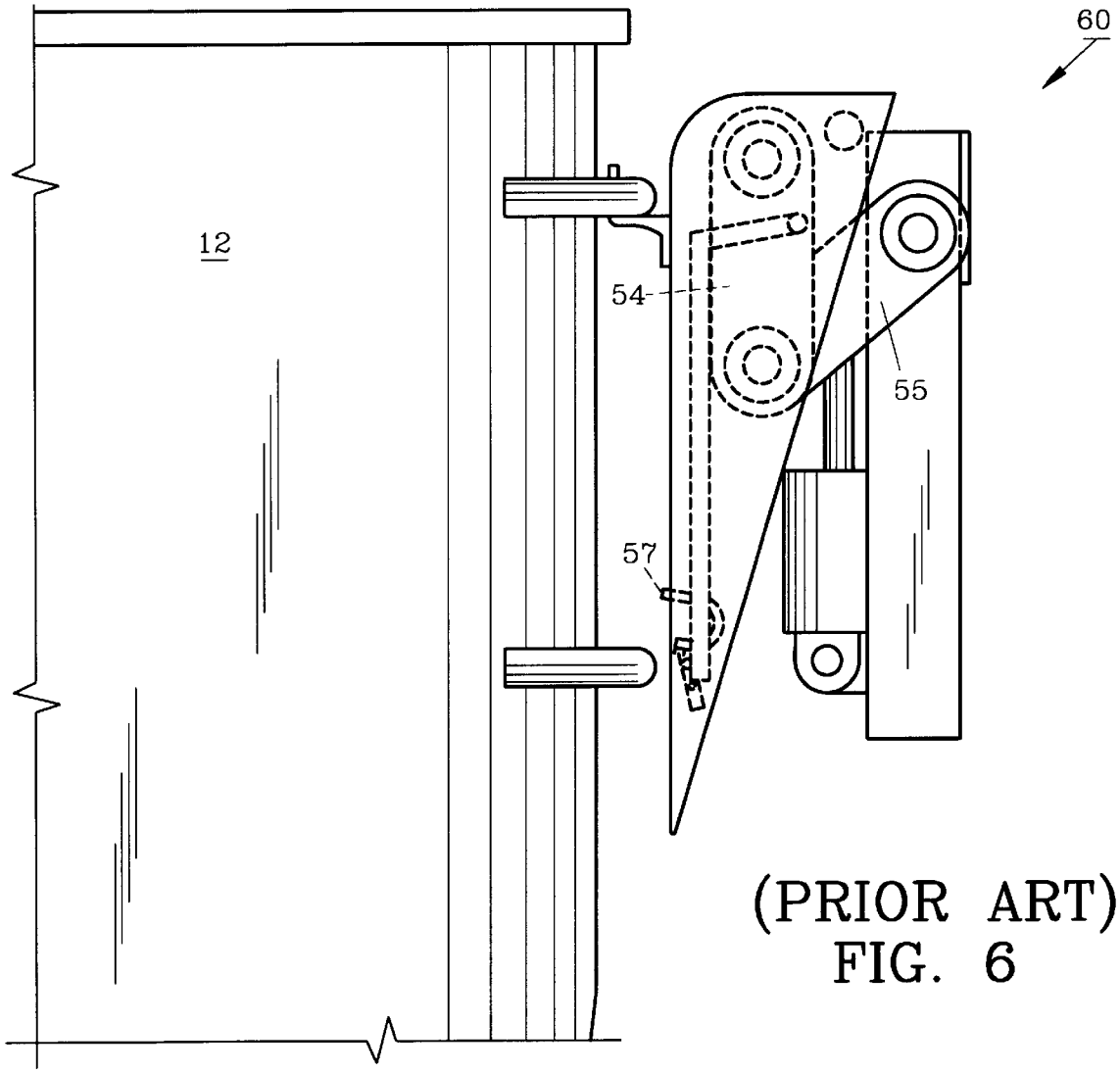
(PRIOR ART) FIG. 6
FIG. 6 shows a conventional dump mechanism removed from the garbage truck with the fragmented in an upright position.
Figure 7:
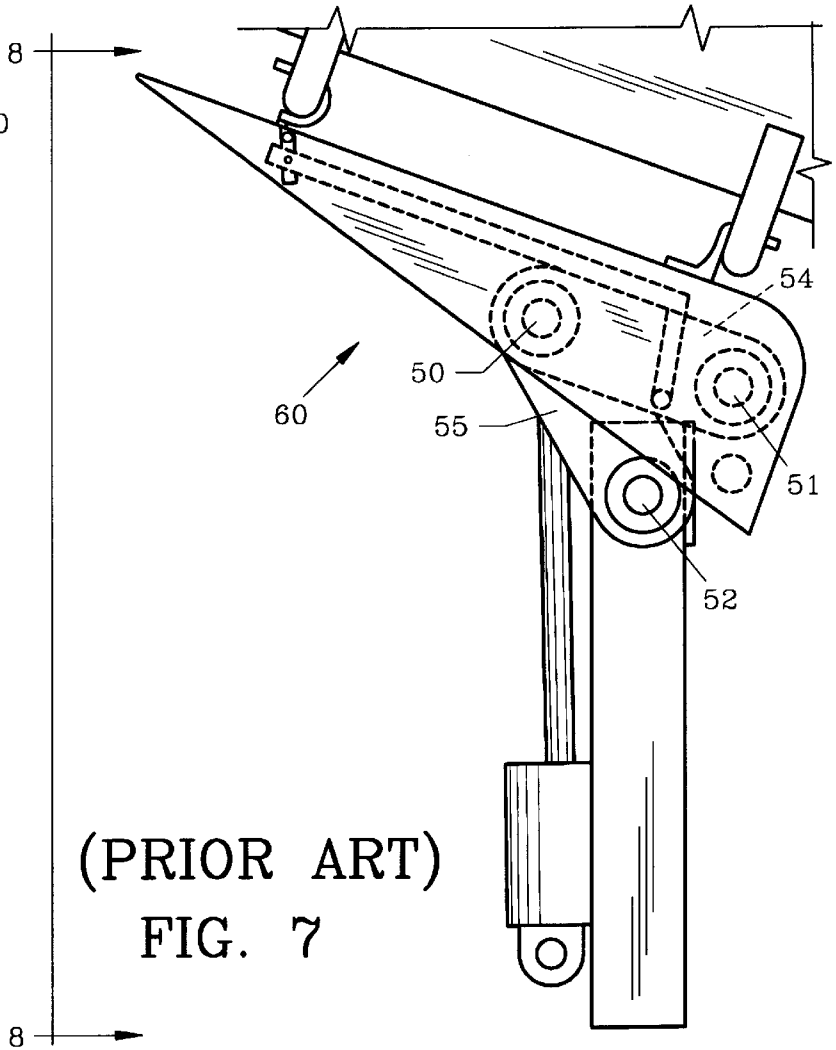
(PRIOR ART) FIG. 7
FIG. 7 is another view of the conventional dump mechanism as shown in FIG. 6 but with the mechanism rotated approximately 100°.
Figure 8:
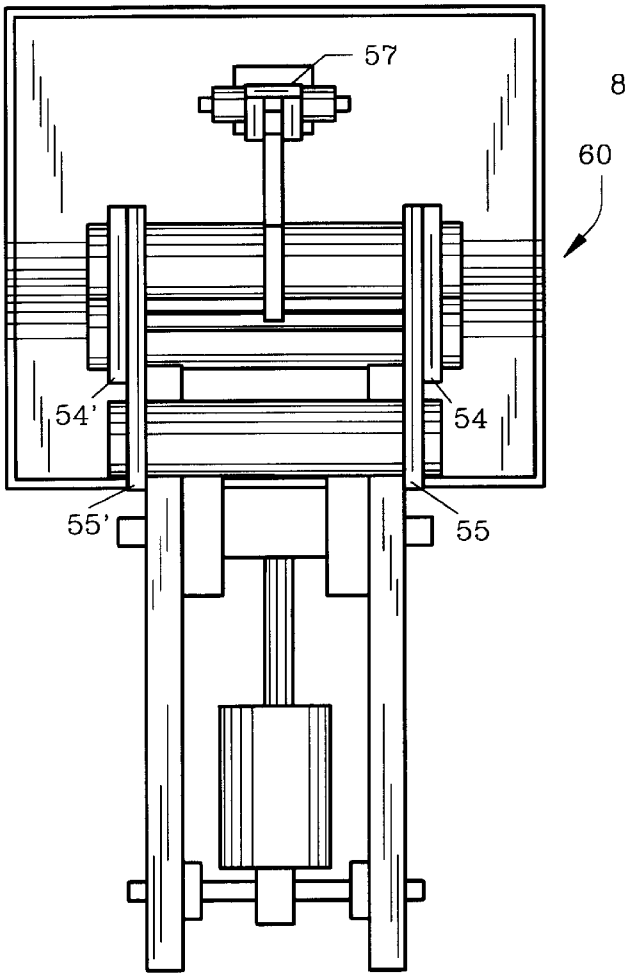
(PRIOR ART) FIG. 8
FIG. 8 is front elevational view of the conventional dump mechanism of FIG. 7 seen along lines 8—8 therein.

In FIGS. 6 through 8, conventional garbage can dump mechanism 60 is shown whereby parallel rollers 50, 51 and 52 are not in a fixed, rigid spatial alignment but instead scissor arms 54, 54' and 55, 55' pivot respectively relative one to another. This pivoting action between arm pairs (54, 55 and 54', 55') causes uneven wear which makes dump mechanism 60 develop uneven, noisy, jerky motions in a relatively short period of use. After sufficient wear, dump mechanism 60 must be replaced in about a year or less.

The illustrations and examples provided herein are for explanatory purposes and are not intended to limit the scope of the appended claims.

I claim:

1. In a garbage can hydraulic dump mechanism as affixed to the rear of a garbage truck, the dump mechanism having a pivotable can support with a fixed catch and a movable catch, the improved dump mechanism comprising:

a) a hydraulic assembly, said assembly comprising a hydraulic cylinder and a piston rod;

b) a handle, said handle positioned on said hydraulic assembly, said handle selectively extending said piston rod;

c) a trio of parallel elongated cylindrical rollers, said trio of rollers rigidly fixed relative to one another and having opposite ends, with i) one of said trio of rollers joined to said can support;

ii) a second of said trio of rollers joined to said hydraulic assembly; and iii) a third of said trio of rollers joined to said movable catch;

d) a resilient member, said resilient member affixed to said third roller to bias the movement of said movable catch; and e) a pair of L-shaped brackets, said pair of brackets affixed at said opposite ends of said trio of parallel rollers for stabilizing the same;

whereby the extension of said hydraulic assembly pivots said can support to dump a garbage can while said movable catch is urged away from said fixed catch to secure the garbage can against the can support.

2. A pivotable garbage can dump mechanism comprising:

a can support, said can support defining a catch aperture;

a fixed catch, said fixed catch attached to said can support;

a movable catch, said movable catch positioned within said catch aperture for rotation through an arc;

a trio of parallel elongated cylindrical rollers, said trio of rollers spatially fixed one to another;

a linkage;

a fourth roller, said fourth roller attached by said linkage to one of said trio of parallel rollers, said fourth roller affixed to said can support;

a pair of L-shaped brackets, said L-shaped brackets engaging said trio of parallel rollers at opposite ends thereof, said brackets for rigidly spacing apart said trio of parallel rollers;

a pair of coil springs, each of said coil springs attached to said movable catch for biasing the same, each of said coil springs attached to one of said trio of parallel rollers;

a hydraulic assembly, said hydraulic assembly comprising:

i) a control valve, ii) a hydraulic line, iii) a hydraulic cylinder, and iv) a piston rod, said piston rod slidably positioned in said hydraulic cylinder, said hydraulic line in fluid communication with said control valve and said hydraulic cylinder, said hydraulic assembly for driving the dump mechanism, said hydraulic assembly attached to one of said trio of parallel rollers, and another of said trio of parallel rollers affixed to said movable catch whereby said hydraulic assembly will extend to pivot said can support thereby causing said movable catch to rotate away from said fixed catch.

* * * * *